US006906474B2

(12) United States Patent
Trestman et al.

(10) Patent No.: US 6,906,474 B2
(45) Date of Patent: Jun. 14, 2005

(54) THREE-PHASE ELECTRONIC BALLAST

(75) Inventors: Grigoriy A. Trestman, Salem, MA (US); Joseph L. Parisella, Beverly, MA (US); Richard H. Koeppl, Topsfield, MA (US)

(73) Assignee: Osram Sylvania, Inc., Danvers, MA (US)

( * ) Notice: Subject to any disclaimer, the term of this patent is extended or adjusted under 35 U.S.C. 154(b) by 0 days.

(21) Appl. No.: 10/674,143

(22) Filed: Sep. 29, 2003

(65) Prior Publication Data

US 2005/0067974 A1 Mar. 31, 2005

(51) Int. Cl.[7] ..... H05B 37/00

(52) U.S. Cl. ..... 315/224; 315/251; 315/DIG. 5; 363/44

(58) Field of Search ..... 315/224, 251, 315/219, DIG. 5, DIG. 7; 363/44, 89

(56) References Cited

U.S. PATENT DOCUMENTS 6,043,997 A * 3/2000 He et al. ..... 363/44
6,343,021 B1 * 1/2002 Williamson ..... 363/8
2004/0085032 A1 * 5/2004 Eckert ..... 315/291

* cited by examiner

*Primary Examiner*—David Vu
(74) *Attorney, Agent, or Firm*—Kenneth D. Labudda

(57) ABSTRACT

A ballast (10) for powering at least one gas discharge lamp (52) from a three-phase AC voltage source (30) comprises a three-phase rectifier circuit (200), a high frequency filter capacitor (300), and a high frequency inverter (400). Preferably, three-phase rectifier circuit (200) is implemented by a six-diode bridge, and high frequency filter capacitor (300) can be realized by a film capacitor or a ceramic capacitor. Ballast (10) provides a high power factor and low total harmonic distortion without requiring a dedicated power factor correction circuit. Other benefits of ballast (10) include enhanced efficiency, longer life, and lower inrush current.

10 Claims, 6 Drawing Sheets

THREE-PHASE ELECTRONIC BALLAST

FIELD OF THE INVENTION

The present invention relates to the general subject of circuits for powering discharge lamps. More particularly, the present invention relates to a three-phase electronic ballast.

BACKGROUND OF THE INVENTION

In recent years, electronic ballasts have begun to displace traditional "core and coil" magnetic ballasts. In comparison with magnetic ballasts, electronic ballasts provide a host of benefits, including dramatically higher energy efficiency and better quality of illumination (e.g., little or no visible flicker in the light emitted by the lamp). On the other hand, magnetic ballasts are usually less expensive and more reliable than electronic ballasts.

A typical prior art single-phase electronic ballast is described in FIG. 1. The ballast includes a 1-phase electromagnetic interference (EMI) filter, a fullwave diode bridge BR1, a power factor correction (PFC) circuit, an electrolytic capacitor C1, and a high frequency inverter. The ballast receives operating power from a single-phase alternating current (AC) voltage source. The DC bus voltage, Vbus, across capacitor C1 is described in FIG. 2.

In the prior art ballast of FIG. 1, the PFC circuit, which is typically realized by a controlled DC-to-DC converter such as a boost converter, is required in order to ensure that the power factor (PF) is high enough, and that the total harmonic distortion (THD) in the current drawn from the AC voltage source is low enough, to meet applicable standards for power quality. Without a PFC circuit, the PF would be much too low (e.g., about 0.5) and the THD would be much too high (e.g., about 150%). Unfortunately, a dedicated PFC circuit is materially expensive, requires a considerable amount of physical space, and has power losses that detract from the energy efficiency of the ballast.

In the prior art ballast of FIG. 1, the large electrolytic bulk capacitor C1 is necessary in order to ensure that the amount of ripple ($\Delta V$ in FIG. 2) in Vbus is sufficiently small so as to prevent excessive low frequency (e.g., 120 hertz) flicker in the illumination provided by the lamp(s). Typically, the electrolytic capacitor has a high capacitance (e.g., 47 microfarads or higher) and a high voltage rating (e.g., 250 volts or higher), and is therefore quite large. Additionally, a high value bulk capacitor causes correspondingly high levels of inrush current. Perhaps the greatest disadvantage of using electrolytic bulk capacitors is encountered in those ballasts that operate in high ambient temperature environments, in which case the ballast's operating life is largely determined by the useful operating life of the electrolytic capacitor (which decreases by a factor of two for every 10° C. increase in operating temperature). Thus, significant impetus exists for developing ballast circuits that do not require electrolytic bulk capacitors.

FIG. 3 describes a typical grouping scheme that is desirable in industrial/office buildings having lighting fixtures that employ single-phase electronic ballasts like the ballast of FIG. 1. In order to equalize the loading on each phase of the 3-phase AC voltage source, it is necessary that the fixtures be divided into groups wherein each group draws about the same amount of power from the AC voltage source. As such a grouping scheme requires that the building be wired so that each of the three phases are distributed accordingly, it greatly complicates the building wiring.

What is needed, therefore, is an electronic ballast that does not require a dedicated PFC circuit or an electrolytic bulk capacitor in order to provide acceptable power quality and illumination without noticeable flicker. A need also exists for a ballast that does not require grouping of lighting fixtures within a building so as to equalize the loading on each phase of the AC voltage source. Such a ballast would offer a number of benefits over existing electronic ballasts, including lower material cost, reduced physical size, higher energy efficiency, enhanced life, lower inrush current, and simplified building wiring, and would thus represent a significant advance over the prior art.

DETAILED DESCRIPTION OF THE PREFERRED EMBODIMENTS

Figure 4:
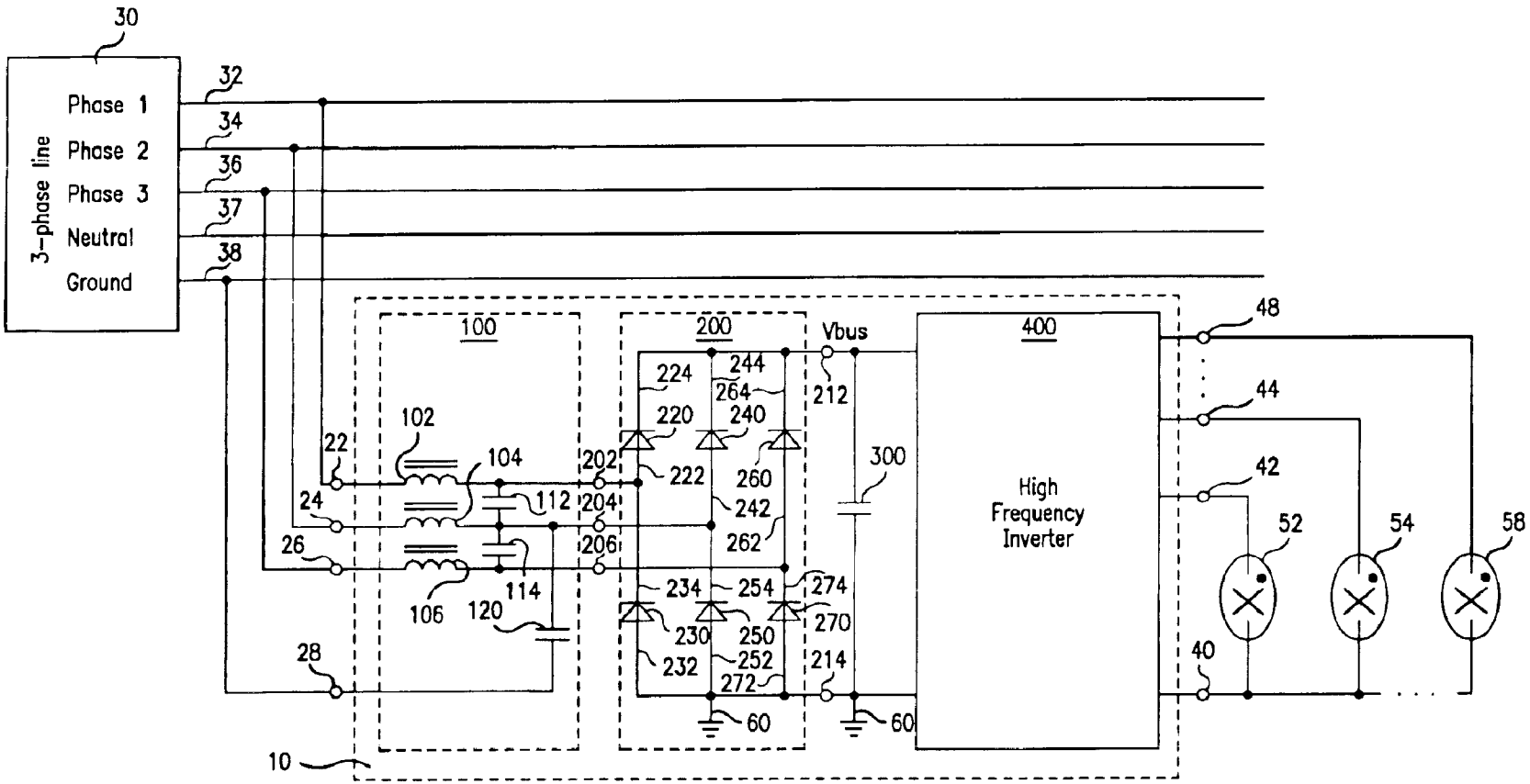
FIG. 4 describes a three-phase electronic ballast, in accordance with a preferred embodiment of the present invention.

A ballast 10 for powering at least one gas discharge lamp 52 from a three-phase alternating current (AC) voltage source 30 is described in FIG. 4. Ballast 10 comprises a three-phase rectifier circuit 200, a high frequency filter capacitor 300, and a high frequency inverter 400. Three-phase AC voltage source 30 is a conventional 60 hertz voltage source that is provided by the electrical utility company.

In a preferred embodiment of ballast 10, three-phase rectifier circuit 200 comprises a first input terminal 202, a second input terminal 204, a third input terminal 206, a first output terminal 212, a second output terminal 214, a first diode 220, a second diode 230, a third diode 240, a fourth diode 250, a fifth diode 260, and a sixth diode 270. First input terminal 202 is adapted to receive a first phase 32 of three-phase AC voltage source 30. Second input terminal 204 is adapted to receive a second phase 34 of source 30. Third input terminal is adapted to receive a third phase 36 of AC source 30. First diode 220 has an anode 222 coupled to first input terminal 202 and a cathode 224 coupled to first output terminal 212. Second diode 230 has an anode 232 coupled to second output terminal 214 and a cathode 243 coupled to first input terminal 202. Third diode 240 has an anode 242 coupled to second input terminal 204 and a cathode 244 coupled to first output terminal 212. Fourth diode 250 has an anode 252 coupled to second output terminal 214 and a cathode 254 coupled to second input terminal 204. Fifth diode 260 has an anode 262 coupled to third input terminal 206 and a cathode 264 coupled to first output terminal 212. Sixth diode 270 has an anode 272 coupled to second output terminal 214 and a cathode 274 coupled to third input terminal 206.

Figure 1:
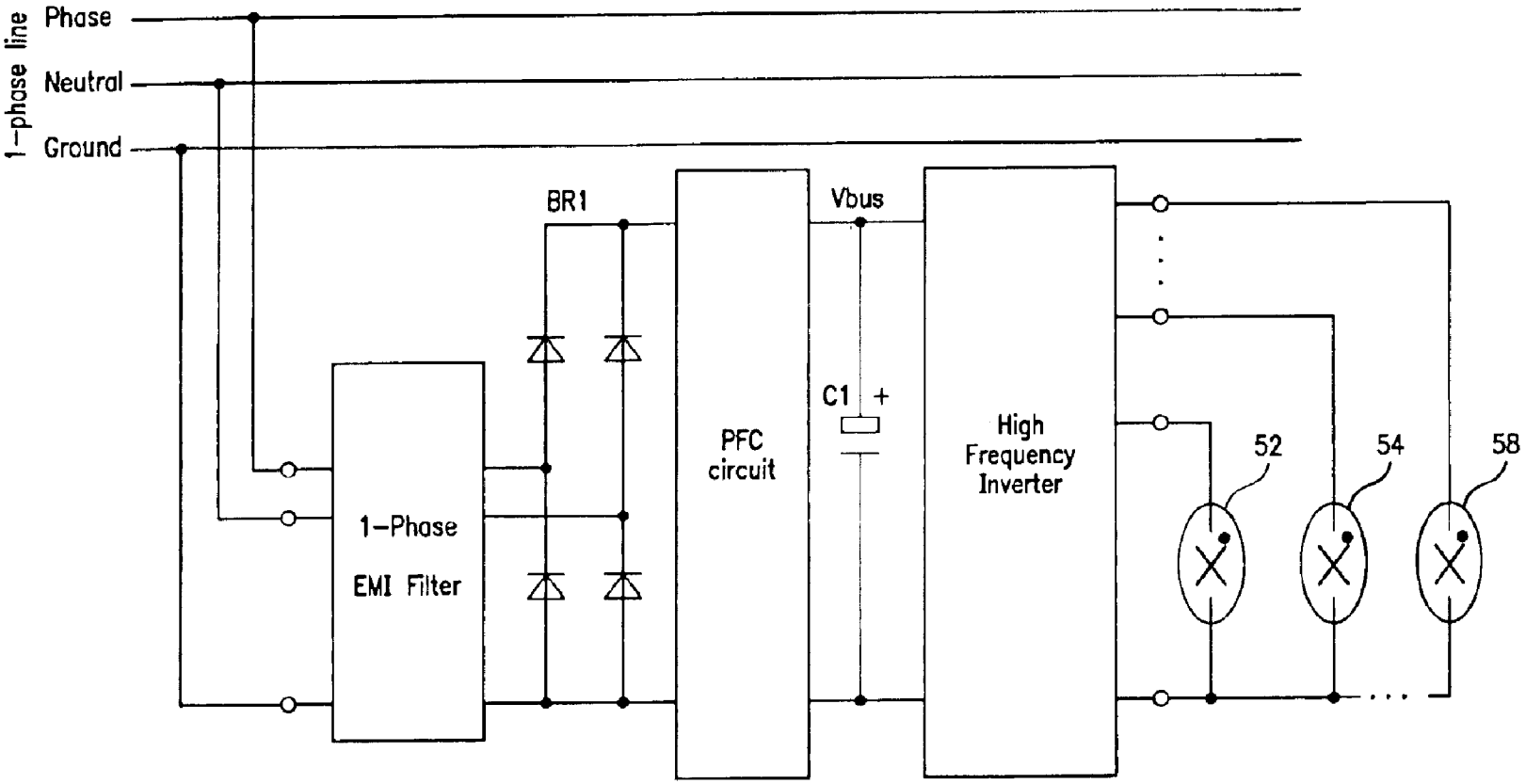
FIG. 1 PRIOR ART
FIG. 1 describes a single-phase electronic ballast, in accordance with the prior art.
Figure 2:
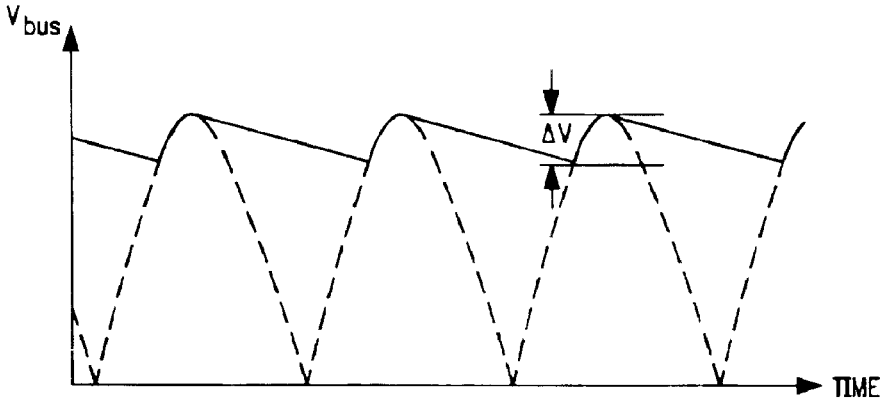
FIG. 2 PRIOR ART
FIG. 2 describes the DC bus voltage provided by the single-phase electronic ballast of FIG. 1.
Figure 5:
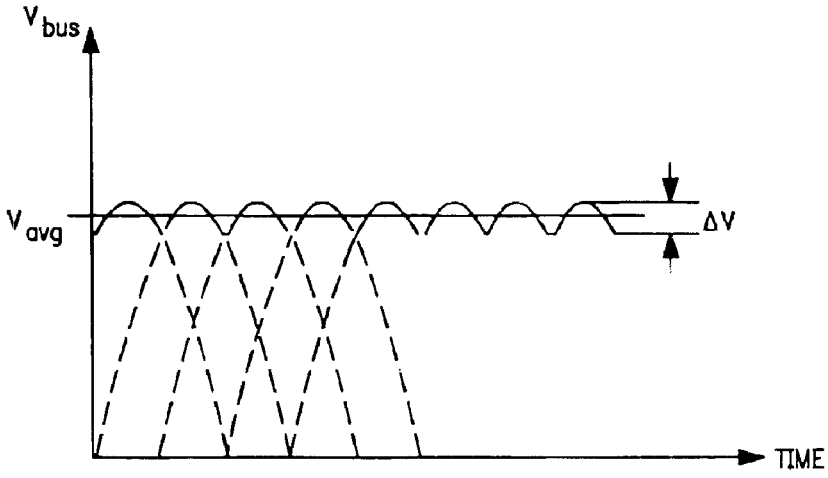
FIG. 5 describes the DC bus voltage provided by the three-phase electronic ballast described in FIG. 4, in accordance with a preferred embodiment of the present invention.

During operation, rectifier circuit 200 receives the three-phase alternating current (AC) voltage source 30 and provides a rectified output voltage. As described in FIG. 5, the rectified output voltage, Vbus, has a maximum value, a minimum value, an average value (Vavg), and a ripple value (ΔV). In ballast 10, the ripple value (ΔV), which is defined as the difference between the maximum value and the minimum value, has a root-mean-square (RMS) value that is no greater than about 5% of the average value Vavg. Advantageously, rectifier circuit 200 utilizes all three phase 32,34,36 of the AC source 30 to provide a Vbus that naturally has a small amount of 360 hertz ripple and that therefore requires no-capacitive filtering in order to provide an acceptably low level of visible flicker in the illumination of the lamp(s). This is in contrast with the prior art ballast of FIG. 1 where, in the absence of a large electrolytic capacitor C1, the 120 hertz ripple would be extremely high, with consequent excessive flicker in the illumination of the lamp(s).

Referring to FIG. 4, high frequency filter capacitor 300 is coupled between the first and second output terminals 212, 214 of rectifier circuit 200. The sole function of capacitor 300 is to provide an AC path for high frequency current drawn by inverter 400. Capacitor 300 can thus be realized by a capacitor with a relatively low capacitance value (e.g., 0.1 microfarads when ballast 10 is designed to power four 32 watt lamps). Consequently, capacitor 300 can be implemented by a film capacitor or a ceramic capacitor. Advantageously, because ballast 10 does not require an electrolytic bulk capacitor, its operating life will be substantially greater than the prior art ballast described in FIG. 1, if the ballast is operated in a high ambient temperature environment. Moreover, because of the relatively low capacitance of capacitor 300, the amount of inrush current that occurs in ballast 10 will be dramatically less than what occurs in the prior art ballast described in FIG. 1.

High frequency inverter 400 is coupled to rectifier circuit 200 and high frequency filter capacitor 300. During operation, inverter 400 powers at least one gas discharge lamp 52 and has an operating frequency that is greater than about 20,000 hertz. In general, inverter 400 includes a plurality of output terminals 40,42,44, . . . ,48 for connection to a plurality of discharge lamps 52,54, . . . ,58. Inverter 400 may be realized by any of a number of circuit arrangements (e.g., a half-bridge inverter followed by a series resonant output circuit) that are well known to those skilled in the art of electronic ballasts.

During operation of ballast 10, the line current that is drawn from each phase 32,34,36 of AC source 30 has a total harmonic distortion (THD) that is no greater than about 33%. Additionally, as the line current drawn from each phase is only moderately out of phase with the voltage between each phase and ground 38, ballast 10 provides a power factor (PF) that is no less than about 0.9. Thus, ballast 10 is capable of approaching or meeting applicable standards for power quality without requiring an active power factor correction (PFC) circuit such as a boost converter. Consequently, in comparison with the prior art electronic ballast described in FIG. 1, ballast 10 provides the added benefits of lower material cost, smaller physical size, and enhanced energy efficiency (e.g., 94% versus about 88% for the ballast of FIG. 1).

Preferably, as described in FIG. 4, ballast 10 further comprises a three-phase electromagnetic interference (EMI) filter 100 that is interposed between rectifier circuit 200 and three-phase AC voltage source 30. During operation, three-phase EMI filter 100 attenuates any line-conducted EMI that tends to arise due to the high frequency operation of inverter 400. In a preferred embodiment of ballast 10, three-phase EMI filter comprises first, second, third, and fourth input connections 22,24,26,28, first, second, and third inductors 102,104,106, and first, second, and third capacitors 112,114, 120. First input connection 22 is adapted to receive a first phase 32 of three-phase AC voltage source 30. Second input connection is adapted to receive a second phase of source 30. Third input connection is adapted to receive a third phase of source 30. Fourth input connection is adapted to receive a ground 38 of source 30. A neutral 37 of source 30 has no corresponding connection to ballast 10. First inductor 102 is coupled between first input connection 22 and the first input terminal 202 of rectifier circuit 200. Second inductor 104 is coupled between second input connection 24 and the second input terminal 204 of rectifier circuit 200. Third inductor 106 is coupled between third input connection 26 and the third input terminal 206 of rectifier circuit 200. First capacitor 112 is coupled between the first and second input terminals 202,204 of rectifier circuit 200. Second capacitor 114 is coupled between the second and third input terminals 204, 206 of rectifier circuit 200. Third capacitor 120 is coupled between fourth input connection 28 and the second input terminal 204 of rectifier circuit 200.

Figure 3:
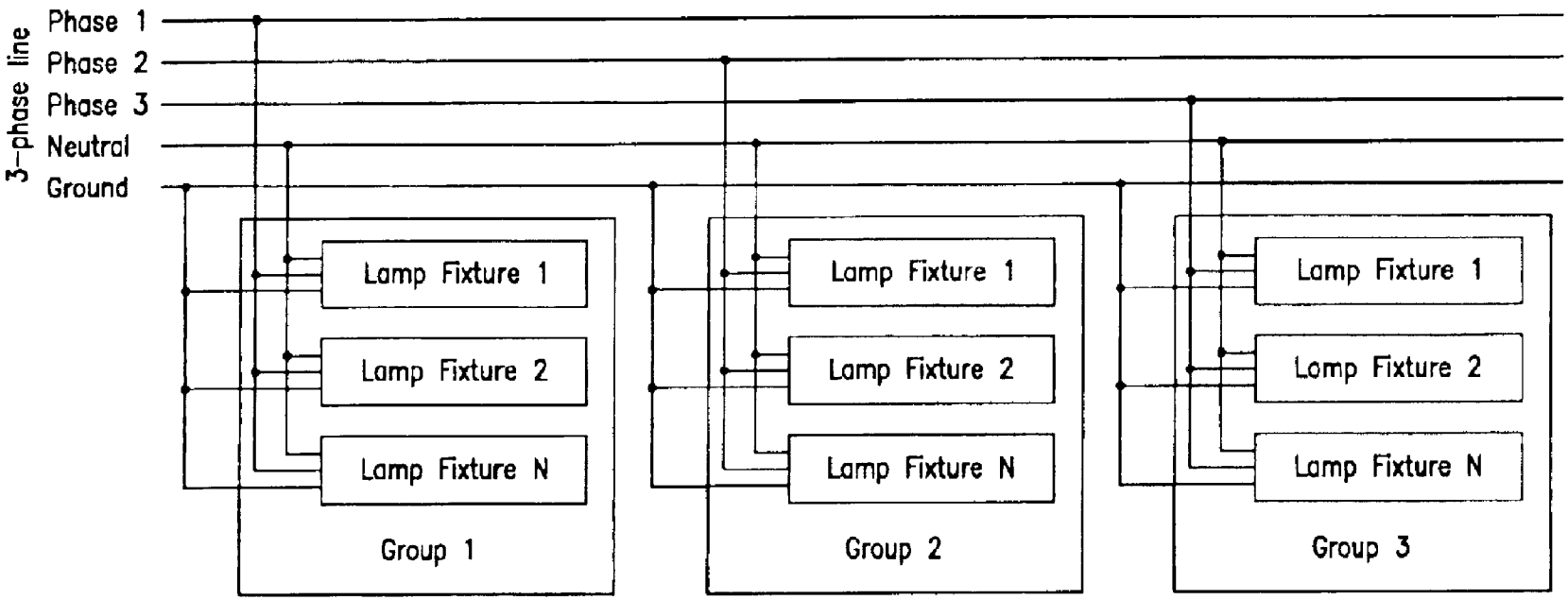
FIG. 3 PRIOR ART
FIG. 3 describes a typical grouping scheme for lighting fixtures that employ the single-phase electronic ballast of FIG. 1.
Figure 6:
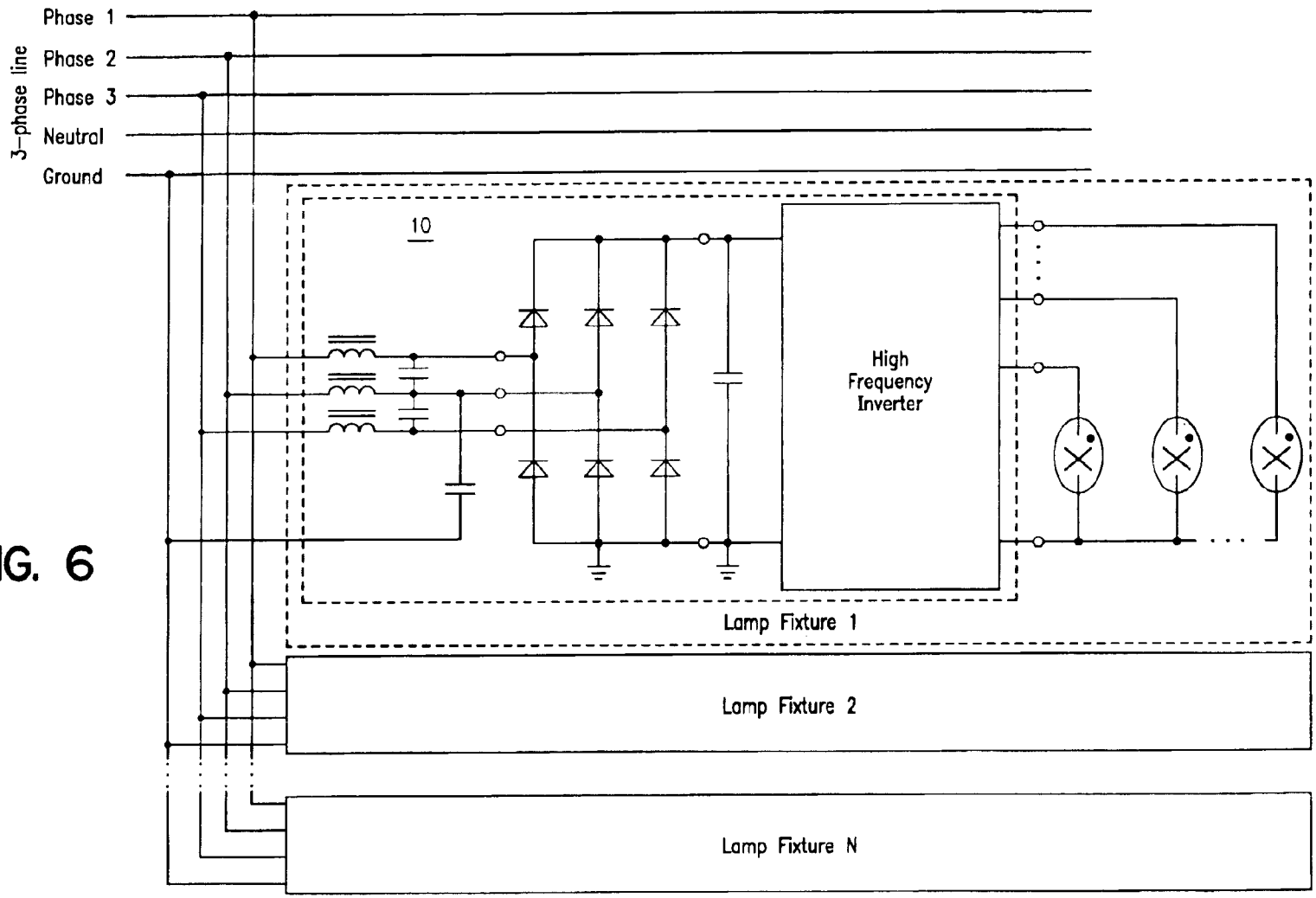
FIG. 6 describes a group of lighting fixtures that employ the threephase electronic ballast described in FIG. 4, in accordance with a preferred embodiment of the present invention.

Turning now to FIG. 6, it can be seen that ballast 10 allows for installations in which all of the fixtures in a building are wired to the AC source 30 in an identical manner. This is in contrast to the arrangement described in FIG. 3, where the fixtures must be segregated into three groups in order to equalize the loading on each phase of the AC source. Thus, ballast 10 provides the added benefit of simplifying the electrical wiring that is routed to the lighting fixtures within a building.

Although the present invention has been described with reference to certain preferred embodiments, numerous modifications and variations can be made by those skilled in the art without departing from the novel spirit and scope of this invention.

What is claimed is:

1. A ballast for powering at least one gas discharge lamp, comprising:

a three-phase rectifier circuit operable to receive a three-phase alternating current (AC) voltage source and to provide a rectified output voltage, wherein the rectified output voltage has a maximum value, a minimum value, an average value, and a ripple value, wherein the ripple value is the difference between the maximum value and the minimum value, and the root-mean-square (RMS) value of the ripple is no greater than about 5% of the average values;

a high frequency filter capacitor coupled to the rectifier circuit; and a high frequency inverter coupled to the rectifier circuit and the high frequency filter capacitor, wherein the inverter is operable to power the at least one gas discharge lamp.

2. A ballast for powering at least one gas discharge lamp, comprising:

a three-phase rectifier circuit operable to receive a three-phase alternating current (AC) voltage source and to provide a rectified output voltage;

a high frequency filter capacitor coupled to the rectifier circuit;

a high frequency inverter coupled to the rectifier circuit and the high frequency filter capacitor, wherein the inverter is operable to power the at least one gas discharge lamp; and a three-phase electromagnetic interference (EMI) filter interposed between the three-phase rectifier circuit and the three-phase AC voltage source, wherein the three-phase EMI filter comprises:

a first input connection adapted to receive a first phase of the three-phase AC voltage source;

a second input connection adapted to receive a second phase of the three-phase AC voltage source;

a third input connection adapted to receive a third phase of the three-phase AC voltage source;

a fourth input connection adapted to receive a ground of the three-phase AC voltage source;

a first inductor coupled between the first input connection and the first input terminal of the rectifier circuit;

a second inductor coupled between the second input connection and the second input terminal of the rectifier circuit;

a third inductor coupled between the third input connection and the third input terminal of the rectifier circuit;

a first capacitor coupled between the first and second input terminals of the rectifier circuit;

a second capacitor coupled between the second and third input terminals of the rectifier circuit; and a third capacitor coupled between the fourth input connection and the second input terminal of the rectifier circuit.

3. A ballast for powering at least one gas discharge lamp, comprising:

a rectifier circuit adapted to receive a three-phase alternating current (AC) voltage source, the rectifier circuit comprising:

a first input terminal for receiving a first phase of the three-phase AC voltage source;

a second input terminal for receiving a second phase of the three-phase AC voltage source;

a third input terminal for receiving a third phase of the three-phase AC voltage source;

first and second output terminals;

a first diode having an anode coupled to the first input terminal and a cathode coupled to the first output terminal;

a second diode having an anode coupled to the second output terminal and a cathode coupled to the first input terminal;

a third diode having an anode coupled to the second input terminal and a cathode coupled to the first output terminal;

a fourth diode having an anode coupled to the second output terminal and a cathode coupled to the second input terminal;

a fifth diode having an anode coupled to the third input terminal and a cathode coupled to first output terminal; and a sixth diode having an anode coupled to the second output terminal and a cathode coupled to the third input terminal;

a high frequency filter capacitor coupled between the first and second output terminals of the rectifier circuit;

an inverter coupled to the first and second output terminals of the rectifier circuit, wherein the inverter is operable to power the at least one gas discharge lamp, the inverter having an operating frequency that is greater than about 20,000 hertz; and a three-phase electromagnetic interference (EMI) filter coupled between the three-phase AC voltage source and the input terminals of the rectifier circuit, wherein the three-phase EMI filter comprises:

a first input connection adapted to receive the first phase of the three-phase AC voltage source;

a second input connection adapted to receive the second phase of the three-phase AC voltage source;

a third input connection adapted to receive the third phase of the three-phase AC voltage source;

a fourth input connection adapted to receive a ground of the three-phase AC voltage source;

a first inductor coupled between the first input connection and the first input terminal of the rectifier circuit;

a second inductor coupled between the second input connection and the second input terminal of the rectifier circuit;

a third inductor coupled between the third input connection and the third input terminal of the rectifier circuit;

a first capacitor coupled between the first and second input terminals of the rectifier circuit;

a second capacitor coupled between the second and third input terminals of the rectifier circuit; and a third capacitor coupled between the fourth input connection and the second input terminal of the rectifier circuit.

4. A ballast for powering at least one gas discharge lamp, comprising:

a rectifier circuit adapted to receive a three-phase alternating current (AC) voltage source, the rectifier circuit comprising:

a first input terminal for receiving a first phase of the three-phase AC voltage source;

a second input terminal for receiving a second phase of the three-phase AC voltage source;

a third input terminal for receiving a third phase of the three-phase AC voltage source;

first and second output terminals;

a first diode having an anode coupled to the first input terminal and a cathode coupled to the first output terminal;

a second diode having an anode coupled to the second output terminal and a cathode coupled to the first input terminal;

a third diode having an anode coupled to the second input terminal and a cathode coupled to the first output terminal;

a fourth diode having an anode coupled to the second output terminal and a cathode coupled to the second input terminal;

a fifth diode having an anode coupled to the third input terminal and a cathode coupled to first output terminal; and a sixth diode having an anode coupled to the second output terminal and a cathode coupled to the third input terminal, wherein the rectifier circuit is operable to provide a rectified output voltage between the first and second output terminals, the rectified output voltage having a maximum value, a minimum value, an average value, and a ripple value, wherein the ripple value is the difference between the maximum value and the minimum value, and the root-mean-square (RMS) value of the ripple is no greater than about 5% of the average value;

a high frequency filter capacitor coupled between the first and second output terminals of the rectifier circuit; and an inverter coupled to the first and second output terminals of the rectifier circuit, wherein the inverter is operable to power the at least one gas discharge lamp, the inverter having an operating frequency that is greater than about 20,000 hertz.

5. The ballast of claim 4, wherein the ballast is operable to draw a line current from each phase of the three-phase AC voltage source, the line current drawn from each phase of the three-phase AC voltage source having a total harmonic distortion (THD) that is no greater than about 33%.

6. The ballast of claim 5, wherein the ballast is operable to provide a power factor (PF) that is no less than about 0.9.

7. A ballast for powering at least one gas discharge lamp from a three-phase alternating current (AC) voltage source, comprising:

a three-phase electromagnetic interference (EMI) filter, comprising:

a first input connection adapted for coupling to the first phase of the three-phase AC voltage source;

a second input connection adapted for coupling to the second phase of the three-phase AC voltage source;

a third input connection adapted for coupling to the third phase of the three-phase AC voltage source; and a fourth input connection adapted for coupling to a ground of the three-phase AC voltage source;

a rectifier circuit, comprising:

first, second, and third input terminals coupled to the three-phase EMI filter;

first and second output terminals;

a first diode having an anode coupled to the first input terminal and a cathode coupled to the first output terminal;

a second diode having an anode coupled to the second output terminal and a cathode coupled to the first input terminal;

a third diode having an anode coupled to the second input terminal and a cathode coupled to the first output terminal;

a fourth diode having an anode coupled to the second output terminal and a cathode coupled to the second input terminal;

a fifth diode having an anode coupled to the third input terminal and a cathode coupled to the first output terminal; and a sixed diode having an anode coupled to the second output terminal and a cathode coupled to the third input terminal;

a high frequency filter capacitor coupled between the first and second output terminals of the rectifier circuit; and an inverter coupled to the first and second output terminals of the rectifier circuit, wherein the inverter is operable to power the at least one gas discharge lamp, the inverter having an operating frequency that is greater than about 20,000 hertz.

8. The ballast of claim 7, wherein:

the high frequency filter capacitor is one of:

a film capacitor; and a ceramic capacitor; and the high frequency filter capacitor has a capacitance that is on the order of about 0.1 microfarads.

9. The ballast of claim 8, wherein the three-phase EMI filter further comprises:

a first inductor coupled between the first input connection and the first input terminal of the rectifier circuit;

a second inductor coupled between the second input connection and the second input terminal of the rectifier circuit;

a third inductor coupled between the third input connection and the third input terminal of the rectifier circuit;

a first capacitor coupled between the first and second input terminals of the rectifier circuit;

a second capacitor coupled between the second and third input terminals of the rectifier circuit; and a third capacitor coupled between the second input terminal of the rectifier circuit and the fourth input connection of the three-phase EMI filter.

10. The ballast of claim 9, wherein:

the rectifier circuit is operable to provide a rectified output voltage between the first and second output terminals, the rectified output voltage having a maximum value, a minimum value, an average value, and a ripple value, wherein the ripple value is the difference between the maximum value and the minimum value, and the root-mean-square (RMS) value of the ripple is no greater than about 5% of the average value; and the ballast is operable to:

(i) draw a line current from each phase of the three-phase AC voltage source, wherein the line current drawn from each phase of the AC source has a total harmonic distortion (THD) that is no greater than about 33%; and (ii) provide a power factor (PF) that is no less than about 0.9.

* * * * *